US006804848B1

(12) United States Patent
Rose

(10) Patent No.: US 6,804,848 B1
(45) Date of Patent: Oct. 19, 2004

(54) HIGH-PROFILE MATTRESS HAVING AN UPPER LOW-PROFILE MODULE WITH AN AIR POSTURIZING SLEEP SURFACE

(75) Inventor: Eric Rose, Easley, SC (US)

(73) Assignee: Comfortaire Corporation, Greenville, SC (US)

( * ) Notice: Subject to any disclaimer, the term of this patent is extended or adjusted under 35 U.S.C. 154(b) by 0 days.

(21) Appl. No.: 10/389,173

(22) Filed: Mar. 14, 2003

(51) Int. Cl.[7] ..... A47C 27/10
(52) U.S. Cl. ..... 5/710; 5/706; 5/738
(58) Field of Search ..... 5/710, 713, 738, 5/737, 706

(56) References Cited

U.S. PATENT DOCUMENTS

| | | | | |
|---|---|---|---|---|
| 5,642,546 | A | 7/1997 | Shoenhair | 5/680 |
| 6,115,861 | A | 9/2000 | Reeder et al. | 5/727 |
| 6,212,718 | B1 | 4/2001 | Stolpmann et al. | 5/713 |
| 6,317,912 | B1 | 11/2001 | Graebe et al. | 5/710 |
| 6,378,152 | B1 | 4/2002 | Washburn et al. | 5/713 |
| 6,430,763 | B2 | 8/2002 | Kosumsuppamala et al. | 5/425 |
| 6,460,209 | B1 | 10/2002 | Reeder et al. | 5/690 |

*Primary Examiner*—Alexander Grosz
(74) *Attorney, Agent, or Firm*—McNair Law Firm, PA; Cort Flint

(57) ABSTRACT

A high-profile air sleep system is disclosed having an air posturizing sleep surface wherein the system comprises a base fabric cover layer, a plurality of resilient blocks overlying the base fabric cover layer, and a middle fabric cover layer overlying resilient blocks. A plurality of air chambers is carried above the middle fabric cover layer, and a resilient pad overlies the air chambers. A top fabric cover layer overlies the resilient pad. The foam blocks provide a cushion for the air chambers and the air chambers provide an upper air posturizing sleep surface. A first closure fasts the base cover layer and the middle cover layer; and a second closure fasts the middle cover layer and the top cover layer together whereby an integral high-profile sleep system is provided with an upper air sleep surface which can be adjusted to provide optimum sleep posture. The air posturizing air chambers are arranged side-by-side and generally coextend with the entirety of the middle, top, and base fabric cover layers.

25 Claims, 4 Drawing Sheets

HIGH-PROFILE MATTRESS HAVING AN UPPER LOW-PROFILE MODULE WITH AN AIR POSTURIZING SLEEP SURFACE

BACKGROUND OF THE INVENTION

This invention is directed to air support sleep systems, and particularly to a multi-compartment high-profile mattress having a base support module and an upper air posturizing module wherein an air posturizing chamber in the upper compartment provides an optimum air posturizing sleep surface.

In the past, air sleep systems have been provided in which one or more air chambers is enclosed in a single module with foam blocks constituting the sidewalls of the unit to prevent sagging such as shown in U.S. Pat. No. 5,642,546. A thin foam overlay is usually placed over the air chambers. While providing a good sleep surface, complete edge-to-edge adjustability using air is not provided because the foam block sidewalls usually occupy about a six inch space on the sides, or about 12" at overall width. The construction normally results in a mattress about 6" to 8" high when the foam overlay is placed over the air chambers. In an attempt to meet the increasing popularity of thicker, high-profile mattresses, additional layers of foam have been stacked upon the air chambers within the mattress casing. However, this has resulted in what is known as "hammocking." Hammocking occurs when the cushioning overly deflates or compresses so that the body assumes a hammock position which strains the lower back. Because the air chambers are now further below the foam layers, the posturizing affect of the adjustable air chambers is less, becoming negligible. In addition, the taller sides of the high-profile mattress casing results in the sides of the mattress sagging and bowing out. The foam and other mattress layers are no longer encased in position and become wobbly resulting in an overall unstable mattress support. The softer and more plush foam cushioning above the air chambers eventually loses its resilience and ability to properly support the person. Posturizing, which is the support of the back in its proper position, has not been reliably achieved in the prior air sleep systems, particularly the high-profile system. Basically, the idea of posturizing is to remove all gaps between the person's body and the sleeping surface without hammocking. Therefore, the need to provide a high-profile mattress, i.e., one that is about 15" in height, using adjustable air chambers is a problem requiring much attention.

Examples of other prior air mattress structure include U.S. Pat. No. 6,378,152 B1 which shows a variable firmness mattress structure in a single module which includes a plurality of longitudinally spaced, transversely extending air bladders whose firmness may be selected individually. U.S. Pat. No. 6,460,209 B1 discloses an air mattress structure wherein an inflatable bladder is positioned upon a plurality of longitudinally spaced foam blocks which are independently moveable relative to one another. U.S. Pat. No. 6,212,718 B1 discloses an air mattress structure which includes a plurality of inflatable air bladders tethered together. U.S. Pat. No. 6,430,763 B2 discloses an air mattress having an approved side bolster system.

Accordingly, an object of the present invention is to provide an air support sleep system wherein proper sleep posture is provided using at least one air posturizing chamber at an upper sleep surface of the mattress.

Another object of the invention is to provide an air support sleep system having an overall high-profile design wherein an upper, low-profile air posturizing module is supported on an integral, lower mattress base module.

Another object of the present invention is to provide a multi-compartment mattress having an upper low-profile module with an adjustable air posturizing sleep surface.

Another object of the present invention is to provide an air support sleep system having a multi-compartment mattress case which includes an upper low-profile fabric encasement and a lower base support encasement wherein an air posturizing assembly is enclosed in the upper encasement and a base foundation assembly enclosed in the lower fabric encasement to provide a one-piece, high-profile mattress design.

Still another object of the present invention is to provide an air support sleep system which may be set up and taken down for transportation and storage having an upper mattress air posturizing module enclosed in an upper fabric encasement with a first releasable closure and a lower mattress base module enclosed in a lower fabric encasement having a second releasable closure for installing and removing a foundation assembly wherein the upper and lower encasements are integral and provide a structural mattress unit.

SUMMARY OF THE INVENTION

The above objectives are accomplished according to the present invention by providing an air support sleep system having an air posturizing sleep surface to provide proper sleep posture comprising an upper mattress air posturizing module having an adjustable air posturizing sleep surface. The module includes an air posturizing assembly having at least one inflatable air chamber providing the adjustable air posturizing sleep surface, and a first mattress case encasing the air posturizing assembly. An access opening in the first mattress case provides access to the interior of the mattress case for installation and removal of the air chamber and for servicing the air chamber. A first releasable closure for the access opening provides opening and closing of the access opening. A mattress base module supports the mattress air posturizing module and includes a resilient foam foundation assembly for providing mattress cushioning. A second mattress case encases the foam foundation assembly. The first and second mattress cases are secured with one another so that the mattress posturizing module and the mattress base module form an integral mattress structure. The mattress air posturizing module and the mattress base module provide a high-profile mattress design with an upper adjustable air posturizing sleep surface.

In one aspect of the invention, the mattress base module has a height profile greater that a height profile of the mattress air posturizing module to provide a high-profile design with a low-profile air posturizing module having mattress stability. Preferrably, the air posturizing assembly includes a pair of individually adjustable air chambers arranged side-by-side, and a resilient overlay disposed over the air chambers generally coextending with the air chambers.

Advantageously, the first mattress case includes a peripheral wall consisting of a pair of spaced sidewalls integral with a pair of end walls. An upper posturizing cover layer and a posturizing bottom layer are integral with the sidewalls and end walls so that the air chambers and overlay are compactly encased by the mattress case in a low-profile design. The low-profile design provides structural mattress stability to the air posturizing module whereby sidewall sagging and bowing is eliminated. The second mattress case includes a peripheral wall consisting of a pair of space sidewalls and integral end walls. An upper base cover layer and a bottom base layer are integral and coextending with the side walls and end walls so that said foundation assembly is encased to provide structural mattress stability to the base module whereby sidewall sagging and bowing is eliminated yet an overall high-profile design is achieved with the first mattress case affixed to the second mattress case.

In an aspect of the invention, a bottom layer of the first mattress case provides the upper cover layer of second mattress case. A second releasable closure may be included for the mattress base module having a first closure part affixed around a periphery of the bottom layer of the first mattress case and a second closure part affixed around a periphery of the side walls and end walls of the second mattress case whereby the first and second mattress cases are affixed together. When the second releasable closure is open the bottom layer of the first mattress case may be at least partially removed whereby at least a partial open top for the mattress base module is provided to permit installation and removal of the base foundation assembly. The first and second releasable closures preferably include first and second zipper-type closures.

In a preferred embodiment, the foundation assembly of the base module includes a plurality of individual resilient foam blocks positioned edge-to-edge and encased in the first mattress case. The foam blocks include individual fabric covers reducing sticking between contacting edges of the blocks in edge-to-edge relationship to maintain an even cushioned support surface. The foundation assembly may also include resilient, generally rectangular bolsters surrounding an outside periphery of the foundation blocks to provide more rigid foundation support around at least side edges of the mattress base module. In the preferred embodiment, the air posturizing assembly includes a pair of air chambers in a side-by-side arrangement coextending entirely with both the foam blocks and the support bolsters of the foundation assembly so that the air chambers overly the entire area of the mattress base module. Thus, a posturizing air sleep surface coextends the entire width of the air posturizing module and the base support module.

Thus, it can be seen that an advantageous construction for a high-profile air sleep system can be had according to the invention which may be taken apart for transportation and storage. The construction comprises a multi-compartment mattress having a self-contained lower fabric encasement and a self-contained upper fabric encasement, a mattress air posturizing module encased in the upper fabric encasement providing an adjustable air posturizing sleep surface, and a mattress base module encased within the lower fabric encasement, providing a cushion for the air posturizing module. A first releasable closure provides access to an interior of the upper fabric encasement for installing and removing the air posturizing assembly from the upper fabric encasement; and a second releasable closure provides access to the mattress base module so that the foundation assembly may-be installed and removed from the lower fabric encasement.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1A:
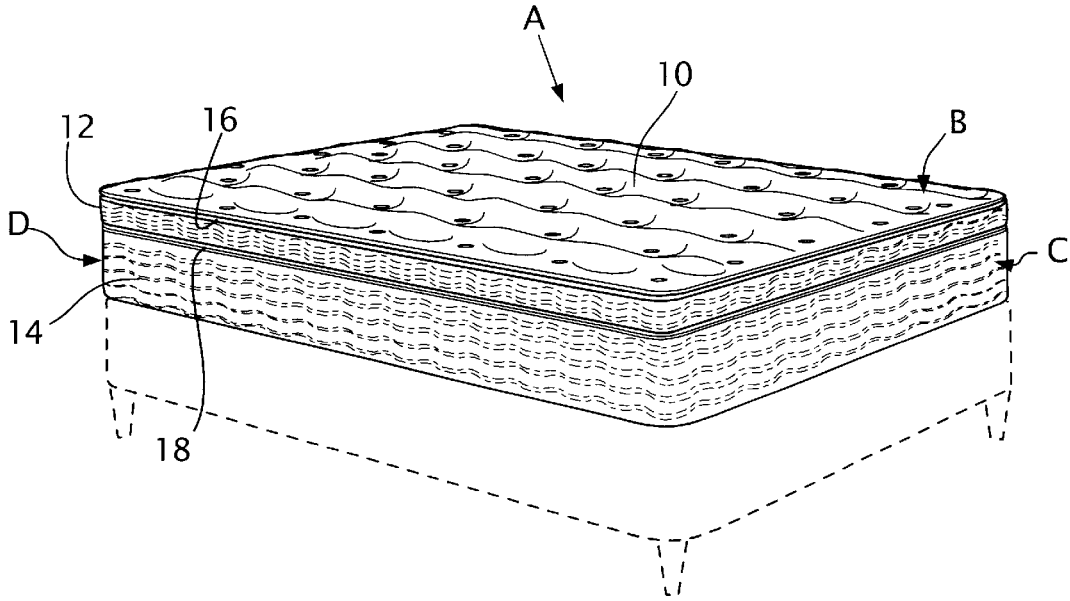
FIG. 1A is a perspective view illustrating a multi-compartment mattress having an upper, low-profile module with an air posturizing sleep surface.

Referring now to the drawings, the invention will now be described in more detail.

Figure 1B:
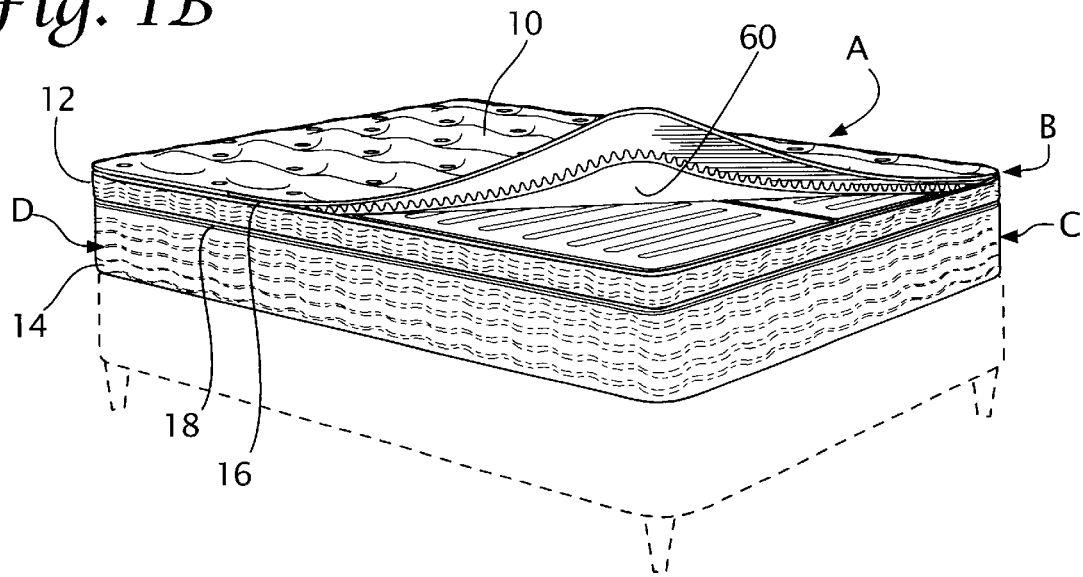
FIG. 1B is a perspective view of the mattress of FIG. 1A with an access opening of the air posturizing module for installation and removal of the air posturizing assembly.

As can best be seen in FIG. 1, an air support sleep system is illustrated, designated generally as A, having an upper air posturizing module, designated generally as B, and a lower mattress base module, designated generally as C. The air posturizing module provides an air posturizing sleep surface 10 which can be adjusted to provide a correct sleeping posture. A mattress case, designated generally as D, includes a upper self-contained fabric encasement 12 and a lower self-contained fabric encasement 14. There is a first releasable closure 16 for fabric encasement 12, and a second releasable enclosure 18 for fabric encasement 14. The upper and lower fabric encasements are made integral to form a unitary mattress case, as will be more fully explained below.

Figure 4:
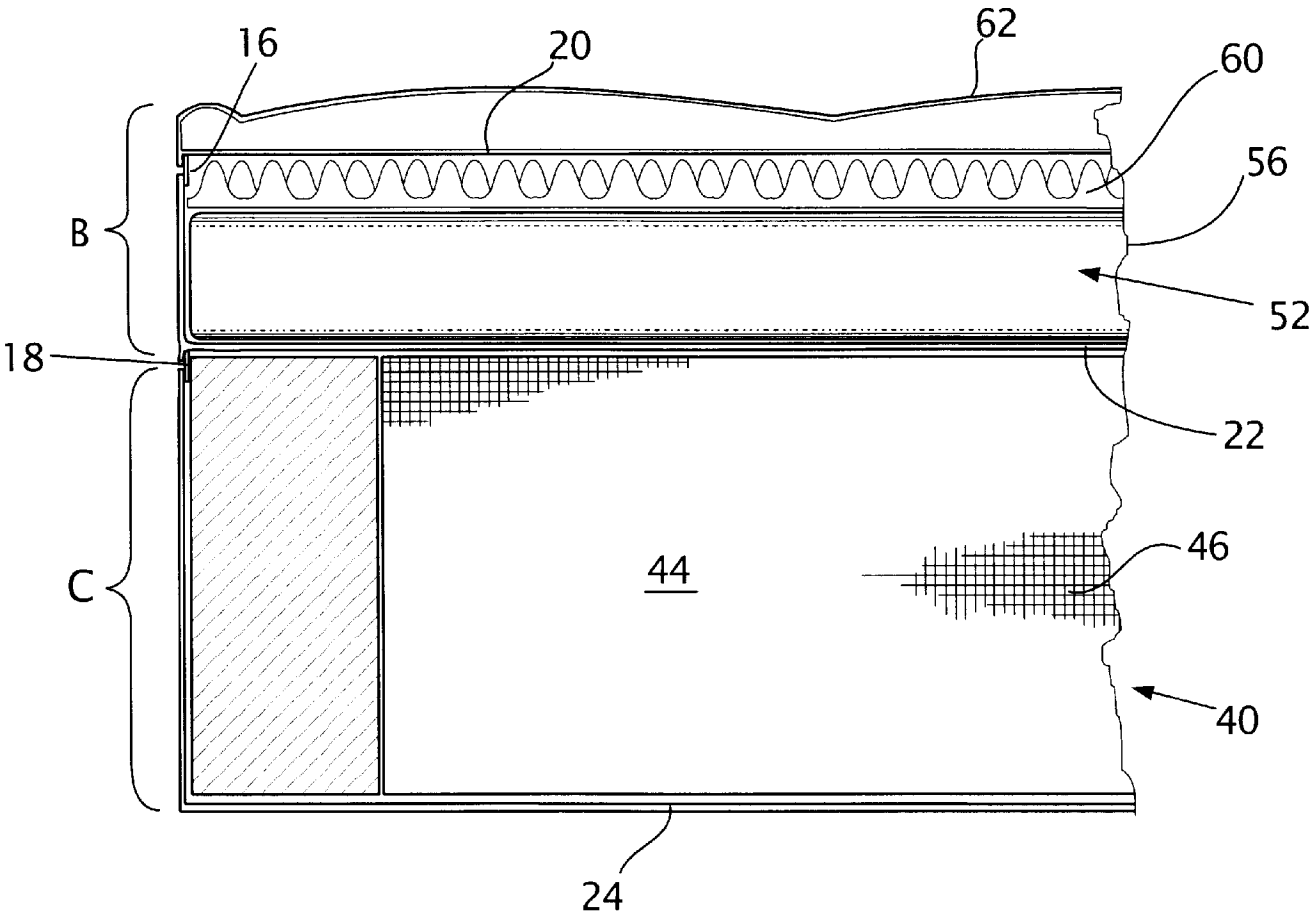
FIG. 4 is a sectional view taken along line 4—4 of FIG. 2.

As can best be seen in FIG. 4, mattress case D includes a top fabric cover layer 20, a middle fabric cover layer 22, and a bottom fabric cover layer 24. Top cover layer 20 is connected to middle cover layer 22 by means of first releasable closure 16 connecting middle layer 22 and peripheral fabric sidewall 28. Middle layer 22 is connected to bottom cover layer 24 by means of peripheral fabric sidewall 30 and second releasable closure 18. It is noted that middle cover layer 22 forms a bottom cover layer for upper mattress module B and a top cover layer for lower mattress module C.

Figure 2:
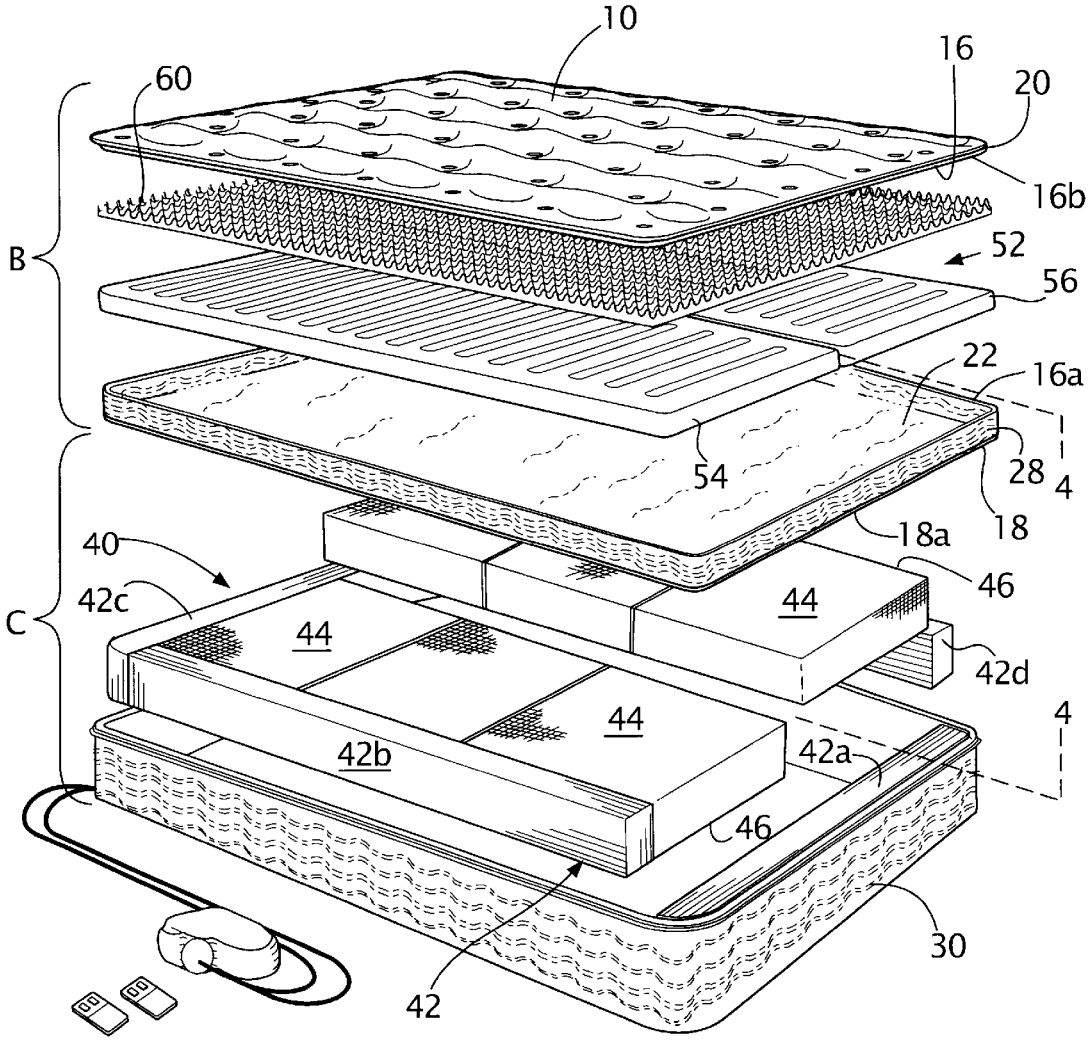
FIG. 2 is a perspective view with parts separated illustrating a multi-compartment mattress having a low-profile air posturizing module and an mattress base module supporting the air posturizing module.
Figure 3:
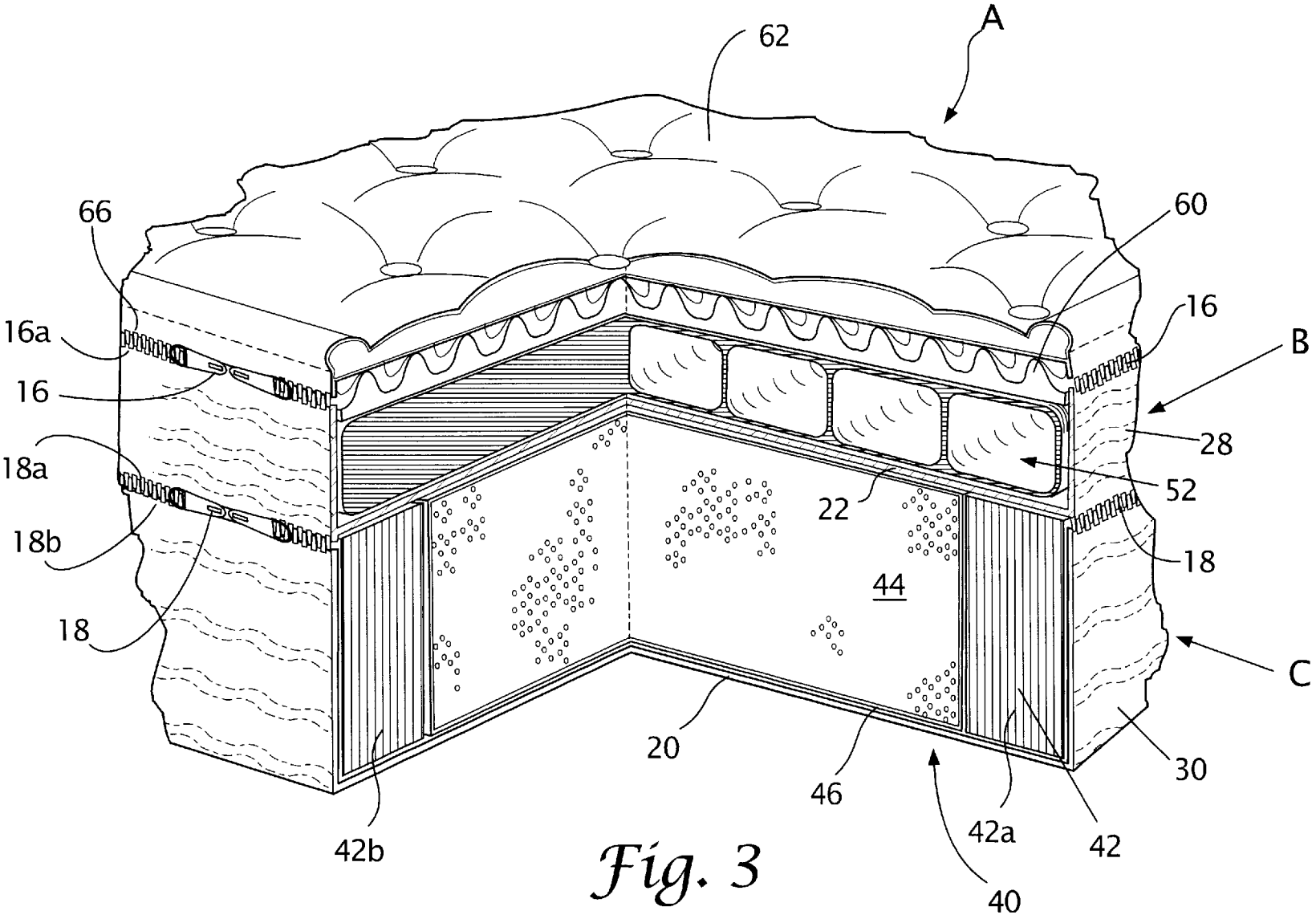
FIG. 3 is a sectional view taken along a corner of the mattress of FIG. 1A.

As can best be seen in FIGS. 2 and 3, a resilient foundation assembly, designated generally as 40, is illustrated which includes a peripheral edge support wall 42 in the form of 4 rectangular bolsters 42*a*–42*d* around the inner periphery of encasement sidewall 28. Inside the peripheral edge support wall 42 is included a plurality of foam blocks 44 encased in a fabric cover 46. In the illustrated embodiment there are 6 blocks 44. The foam blocks may be any suitable resilient foam such as Omalon, manufactured by The Carpenter Company of Hickory, N. C. The fabric cover around the foam blocks prevent them from sticking which would alter the support characteristics of the support base. The rectangular bolsters 42 are preferably a resilient, high-density foam, having a density, for example, of 1.6. The edge support wall provided by the foam bolsters provides a more rigid support than the foam blocks for edge support. Overlying the foam blocks is a top cover provided by middle fabric layer 22. Second releasable closure 18 includes a zipper closure having a first zipper part 18*a* carried around the periphery of fabric layer 22, and a second zipper part 18*b* formed around the outer periphery of encasement sidewall 30. In this way, an access opening in the form of an open top 40 can be had for the lower fabric encasement so that the edge wall and foam blocks may be inserted to provide the foundation assembly.

Referring now in more detail to upper mattress, low-profile air posturizing module B, it can be seen that the air posturizing assembly, designated generally as 52 is included in upper fabric encasement 12. In the illustrated embodiment, the air posturizing assembly includes a pair of air chambers 54 and 56 arranged side-by-side and resting on middle fabric cover layer 22 within encasement peripheral sidewall 28. The air chamber is 2" to 3" in height in order to prevent hammocking. The air chambers may be made from any suitable material such as a thermo plastic urethane. The air posturizing chambers combined with the comfort layer and lower foam supporting base provide an overall comfort and firm support surface. As can best be seen in FIG. 2, air chambers 54, 56 are dimensioned to fit tightly between the opposite sidewalls of encasement 12 so that they overly the entire area of foundation assembly composed of edgewall bolsters 42*a*–42*d*, and foam blocks 44. In this way, an air posturizing surface is provided completely over the entire surface area of the mattress, whereas in the prior mattresses, the air chambers were not allowed to overly the edge support wall. Next, overlying air chambers 54, 56 is a resilient pad 60. In the preferred embodiment, pad 60 is composed of a visco elastic foam providing a luxurious feel to the upper air posturizing sleep surface 10. Upper fabric cover layer 20 covers the resilient pad 60. A conventional "pillow top" pad 62 may be made integral with the top of cover layer 20. First releasable closure 16 is illustrated in the form of a zipper closure having a first zipper part 16a formed around the upper periphery of encasement wall 28, a second zipper part 16b carried around the edge of fabric layer 20. In this manner, with the zipper zipped all the way around the encasement wall and upper cover, a snug tight fit of air posturizing assembly 52 within the low-profile module B is provided. With the low-profile module B secured to the mattress base support C, an integral mattress structure is provided wherein shifting and sagging of the compartments is reduced, if not eliminated. Upper air posturizing sleep surface 10 may be selected to provide the correct posture by adjusting the air in the air chambers immediately below the sleep surface. In this manner, the adjustment of the air chamber is felt immediately upon the posture, rather than through thick layers of foam, as in the prior art. Moreover, a cushioned and firm support of the air posturizing module is provided by the zipper closures, an overall high-profile mattress unit is provided.

Thus, it can be seen that a highly advantageous construction can be had achieving the objectives of the invention by providing a high-profile air sleep system having a low-profile air module which provides an adjustable posturizing surface on top of a base support module comprised of foam. This minimizes hammocking. The base module can be provided in a desired height profile so that the overall height combination of the low-profile module and the base support module results in a high-profile mattress design in keeping with modem trends. A comfort layer is overlaid on the air chambers for additional comfort. The upper low-profile air module may also be provided with a quilted top for additional comfort. Originally it was thought one had to have firmness in the sleeping support surface, however, now one can actually have a plush sleeping surface and still have low back support. The combination of these two elements is achieved according to the invention, together with sleeping surface comfort and support.

While a preferred embodiment of the invention has been described using specific terms, such description is for illustrative purposes only, and it is to be understood that changes and variations may be made without departing from the spirit or scope of the following claims.

What is claimed is:

1. An air sleep system having an upper air posturizing sleep surface comprising:

(a) an upper mattress air posturizing module having an adjustable air posturizing sleep surface, said module including:

an air posturizing assembly having at least one inflatable air chamber providing the adjustable air posturizing sleep surface, a first mattress case encasing said air posturizing assembly, an access opening in said first mattress case providing access to an interior of said mattress case for installation and removal of said air chamber and for servicing said air chamber; and a first releasable closure for said access opening for opening and closing said access opening;

(b) a mattress base module supporting said air posturizing module which includes;

a resilient foam foundation assembly for providing mattress cushioning, and a second mattress case encasing said foam foundation assembly; and (c) said first and second mattress cases being secured with one another so that said mattress posturizing module and said mattress base module form an integral mattress structure;

whereby said mattress air posturizing module and said mattress base module provide an overall mattress design with an upper adjustable air posturizing sleep surface.

2. The system of claim 1 wherein said mattress base module has a height profile greater that a height profile of said mattress air posturizing module to provide a high-profile design with a low-profile air posturizing module having mattress stability.

3. The system of claim 1 wherein said air posturizing assembly includes a pair of individually adjustable air chambers arranged side-by-side, and a resilient overlay disposed on top of said air chambers generally coextending with said air chambers.

4. The system of claim 3 wherein said first mattress case includes a pair of spaced sidewalls integral with a pair of end walls, an upper posturizing cover layer and a posturizing bottom cover layer integral and coextending with said sidewalls and said end walls so that said air chambers and overlay are compactly encased to provide structural mattress stability to said air posturizing whereby sidewall sagging is eliminated.

5. The system of claim 4 wherein said second mattress case includes a pair of spaced sidewalls and integral end walls, an upper base cover layer and a bottom base cover layer integral and coextending with said side walls and end walls so that said foundation assembly is encased to provide structural mattress stability to said base module whereby sidewall sagging is eliminated.

6. The system of claim 5 wherein said first mattress case is secured to said second mattress case by physically affixing said mattress cases together.

7. The system of claim 6 wherein said bottom layer of said first mattress case provides the upper cover layer of said second mattress case.

8. The system of claim 7 including a second releasable closure for said mattress base module having a first closure part affixed around a periphery of said bottom cover layer of said first mattress case and a second closure part affixed around a periphery of said sidewalls and end walls of said second mattress case whereby said first and second mattress cases are affixed together when said second releasable closure is closed; and said bottom layer of said first mattress case may be at least partially removed whereby at least a partial open top for said mattress base module is provided to permit installation and removal of said base foundation assembly.

9. The system of claim 8 wherein said first and second releasable closures include first and second zipper closures.

10. The system of claim 1 wherein said foundation assembly includes a plurality of individual resilient foam blocks positioned edge-to-edge and encased in said first mattress case.

11. The system of claim 10 wherein said foam blocks include individual fabric covers reducing sticking between contacting edges of said blocks in edge-to-edge relationship to maintain a uniform cushioned support surface.

12. The system of claim 11 wherein said foundation assembly includes resilient generally rectangular bolsters surrounding an outside periphery of said foundation blocks to provide foundation support around at least side edges of said mattress base module.

13. The system of claim 12 wherein said air posturizing assembly includes at least one air chamber coextending with both said foam blocks and said support bolsters of said foundation assembly so that at least one air chamber generally overlies the entire area of said mattress base module.

14. The system of claim 1 wherein said air posturizing assembly includes a pair of air chambers arranged side-by-side and coextending with said foundation assembly so that said air chambers generally overlie the entire area of said mattress base module.

15. The system of claim 14 including a resilient overlay overlying said air chambers proving cushioning to said air posturizing sleep surface.

16. A high-profile air sleep system comprising:

a multi-compartment mattress case having a self-contained lower fabric encasement and a self-contained upper fabric encasement, and said upper and lower fabric encasements being integral with one another;

an access opening formed in at least said upper fabric encasement for access to the interior of said upper encasement, and a releasable closure for closing and opening said access opening;

a mattress air posturizing assembly encased in said upper fabric encasement providing an upper mattress module, said releasable closure having a released configuration providing access to said air posturizing assembly for installation, removal, and servicing; and, a mattress base assembly encased within said lower fabric encasement providing a lower mattress module to provide a cushion for said air posturizing module.

17. The system of claim 16 wherein said lower mattress module has a height profile greater that a height profile of said mattress air posturizing module.

18. The system of claim 16 wherein said base assembly includes a plurality of foam blocks, and resilient generally rectangular bolsters surrounding an outside periphery of said foam blocks to provide foundation support around at least side edges of said mattress base module.

19. The system of claim 18 wherein said air posturizing assembly includes at least one air chamber coextending with both said foam blocks and said rectangular bolsters of said base assembly so that said at least one air chamber generally overlies the entire area of said mattress base module.

20. A high-profile air sleep system which may be taken apart for transportation and storage comprising:

a multi-compartment mattress having a self-contained lower fabric encasement and a self-contained upper fabric encasement;

a mattress air posturizing module encased in said upper fabric encasement having at least one adjustable air chamber providing an air posturizing sleep surface;

a mattress base module encased within said lower fabric encasement, and said base mattress module including a plurality of resilient foam blocks providing a cushion for said air posturizing module;

a first releasable closure providing access to an interior of said upper fabric encasement for installing and removing said air posturizing assembly from said upper fabric encasement; and a second releasable closure providing access to said mattress base module so that said foundation assembly may be installed and removed from said lower fabric encasement.

21. The system of claim 20 wherein said mattress base module has a height profile greater that a height profile of said mattress air posturizing module.

22. The system of claim 20 wherein said foundation assembly includes resilient generally rectangular bolsters surrounding an outside periphery of said foundation blocks to provide foundation support around at least side edges of said mattress base module.

23. The system of claim 22 wherein said air posturizing assembly includes at least one air chamber coextending with both said foam blocks and said support bolsters of said foundation assembly so that said at least one air chamber generally overlies the entire area of said mattress base module.

24. A high-profile air sleep system having an air posturizing sleep surface comprising:

a base fabric cover layer;

a plurality of resilient blocks overlying said base fabric cover layer;

a middle fabric cover layer overlying said resilient blocks;

a plurality of air chambers carried above said middle fabric cover layer;

a resilient pad overlying said air chambers; and a top fabric cover layer overlying said resilient pad;

said foam blocks providing a cushion for said air chambers and said air chambers providing an upper air posturizing sleep surface;

a first closure fastening said base cover layer and said middle cover layer; and a second closure fastening said middle cover layer and said top cover layer together.

25. The system of claim 24 wherein said air posturizing assembly includes a pair of individually adjustable air chambers arranged side-by-side, and a resilient overlay disposed on top of said air chambers generally coextending with said air chambers; and said air chambers coextending over the entirety of said middle, top, and base fabric cover layers.

* * * * *